United States Patent [19]

Weitzman

[11] 4,109,825

[45] Aug. 29, 1978

[54] ROTATABLE COMPARTMENTALIZED VENDING APPARATUS

[76] Inventor: Barry Sheldon Weitzman, 23875 Park Del Monte, Calabasas Park, Calif. 91302

[21] Appl. No.: 748,408

[22] Filed: Dec. 8, 1976

[51] Int. Cl.[2] ..... G07F 11/54

[52] U.S. Cl. ..... 221/14; 221/20; 221/122

[58] Field of Search ..... 221/14, 18–20, 221/121, 122, 133, 264, 265; 133/5 R; 194/85

[56] References Cited

U.S. PATENT DOCUMENTS

| | | | |
|---|---|---|---|
| 819,422 | 5/1906 | Green | 221/14 X |
| 1,517,377 | 12/1924 | Mortensen | 194/85 |
| 1,697,510 | 1/1929 | Morin | 221/20 |
| 2,876,928 | 3/1959 | Adams et al. | 221/20 X |
| 2,990,084 | 6/1961 | Probasco | 221/122 |
| 3,122,401 | 2/1964 | Johnson | 221/122 X |

*Primary Examiner*—Robert B. Reeves
*Assistant Examiner*—David A. Scherbel
*Attorney, Agent, or Firm*—Gardner and Anten

[57] ABSTRACT

A vending apparatus which includes a rotatable dispensing member having a plurality of separate storage compartments for storing a plurality of items to be dispensed in a predetermined manner is disclosed. A stop member is provided to disable the operation of the vending apparatus upon depletion of all of the items in any of the storage compartments from which an item is selected.

9 Claims, 10 Drawing Figures

ROTATABLE COMPARTMENTATLIZED VENDING APPARATUS

BACKGROUND OF THE INVENTION

The present invention is directed to an improved compartmentalized vending machine for dispensing goods not conveniently dispensed in a bulk loading dispensing machine. In the art, bulk loading vending machines are those machines normally associated with gumball dispensers, where the precise item dispensed is randomly selected and deposited in an outlet chute. In compartmentalized vending machines, the items to be dispensed are dispensed in a predetermined or selected manner, such as cigarette vending machines.

Compartmentalized vending machines have been available in the prior art, although there have been disadvantages associated therewith. For example, though some vending machines have a plurality of compartments available for storing items to be dispensed, such vending machines were large, bulky and expensive to manufacture. For example, cigarette vending machines had separate activating controls associated with each compartment. The requirement of a separate control or activating mechanism for each compartment resulted in the increased cost of manufacture, as well as increasing the possibility of malfunctions associated with the use of the machine.

SUMMARY OF THE PRESENT INVENTION

The present invention provides an improved compartmentalized vending apparatus which employs a single operating mechansim. In particular, the vending apparatus of the present invention includes a dispensing member having a plurality of compartments for storing a plurality of items in each of the compartments. Different items may be stored in each compartment. A weighted movable stop member is placed upon the top of each of the stacks of items contained in the compartments to bias the items downwardly toward a dispensing assembly, as well as to prevent operation of the dispensing apparatus when a compartment is selected from which all the items have been depleted.

The dispensing assembly includes a carrying plate which is rotatable when a handle associated with a coin receiving portion of the apparatus located on the exterior of the machine is rotated, the carrying plate being mechanically coupled to the handle. The items to be dispensed are selected by rotating the compartments by means of an external selection handle so that the item to be selected is in a predeteremined position so that the item may be received by an opening located in the carrying plate and carried to a dispensing area when the activation handle is rotated.

The weighted stop member has an extended pivotal member along its bottom for engagement with a depression in the movable carrying plate for preventing further rotation of the carrying plate relative to the item holding compartments when the compartment is empty. The carrying plate and knob mechanism being mechanically coupled, rotation of the activation handle is thereby prevented.

It is an object of the present invention to provide an improved compartmentalized vending apparatus.

It is a further object of the present invention to provide an improved compartmentalized vending apparatus having a plurality of item-carrying compartments activated by a single control.

It is still a further object of the present invention to provide an improved compartmentalized vending apparatus which is simple to manufacture and will operate reliably.

These and other objects of the present invention will be evident from reference to the following description and the accompanying drawings.

DESCRIPTION OF THE PREFERRED EMBODIMENT

Figure 1:
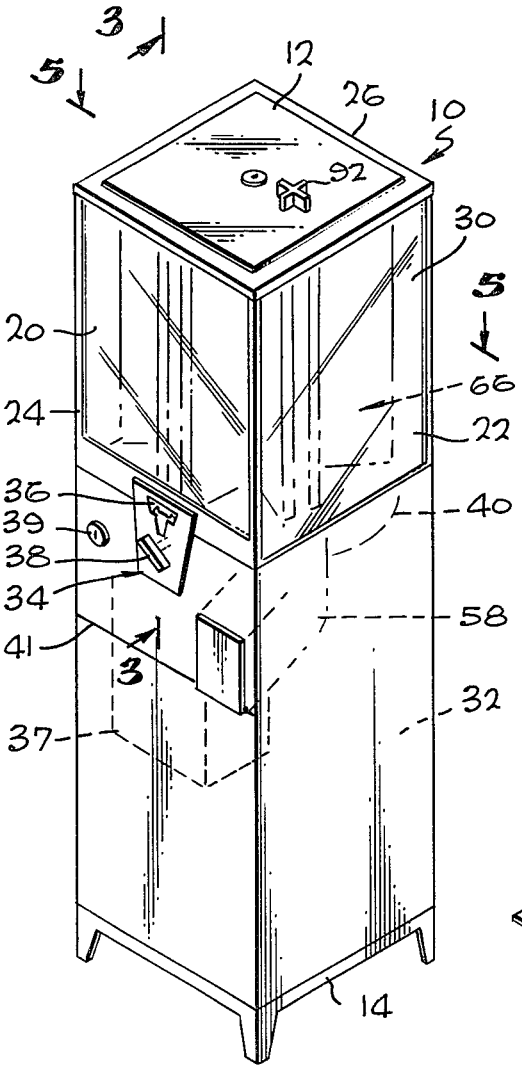
FIG. 1 is a perspective view of the vending apparatus of the present invention.

Referring to FIG. 1, a perspective view of the novel vending apparatus 10 of the present invention is illustrated. The vending apparatus 10 comprises an essentially rectangular, elongated enclosure having a top cover 12, a bottom portion 14, sides 20 and 22, front 24 and rear 26. An internal plate 28 defines an internal upper secton 30 and a lower internal section 32.

A coin receiving assembly 34 is located on the exterior of the front surface 24 of the bottom portion 14 and includes a coin receiving slot 36 and a rotatable handle 38 which may be rotated only upon the presence of a proper sized coin being located in the coin receiving slot 36. The coin receiving assembly 34 is of the type conventionally used in the art. A coin receiving container 37 is positioned on the lower internal section 32 and may be removed upon unlocking lock 39 and opening door 41.

Positioned within the internal upper section 30, supported by housing 40, is a substantially circular disc shaped carrying plate 42 having its top surface 44 flush with the top surface of internal separation plate 28. The carrying plate 42 has gear teeth 46 located about its lower circumferential surface for engagement by translation gear 48 which is connected by extension rod 50 to handle 38. The translation gear engages the gear teeth 46 of the carrying plate 42 through an opening 49 in housing 40. The carrying plate 42 is rotatable about its central axis 52 in a horizontal plane. Extension rod 50 passes through an opening in translation gear 48 and connects to inactivation cam 53 positioned below the central portion of carrying plate 42 forming part of inactivation assembly 77.

The carrying plate 42 has a plurality of generally rectangular shaped openings 54, distributed uniformly radially, in the carrying plate 42 so as to be able to be brought into alignment with a dispensing opening 56 of generally similar shape. The dispensing chute 58, of a generally hollow configuration, is located in the lower internal section 32 with one end proximate the dispensing opening 56 in separation plate 28 and its other end 60 opening external of the vending apparatus 10. The external opening 60 of the dispensing chute 58 is normally covered by a pivotable flap, not shown, so as to prevent the items being dispensed from falling from the vending machines during operation of the coin assembly 34.

Positioned above the separation plate 28 and the carrying plate 42 is a thin cover plate 62 which substantially covers the entire top surface of separation plate and carrying plate 42. In the preferred embodiment, the cover plate 62 is a thin sheet metal. The cover plate 62 has a substantially rectangular opening 64 of a size at least as large as the items to be dispensed and positioned so as to align with the carrier plate openings 54.

Located above the cover plate 62 is a compartmentalized member 38 which is mounted about a central axis 68 which passes through openings 70 in cover plate 62 and opening 72 in carrying plate 42. In the preferred embodiment of the present invention, the compartmentalized member consists of six generally elongated rectangularly shaped hollow vertical extending item holding compartments 74, having rear walls 76, side walls 78 and 80 and front wall 82. The front walls have a slot 84 substantially along the entire longitudinal length to permit access to the interior of the item holding compartments, as well as to permit the stop member to protrude out of the item holding compartment. The rear wall 76 of the item holding compartments 74 is mounted to a generally hexagonally shaped hub member 86 fixably mounted to axis 68 for rotation therewith. Located on the top surface of hub 86 is a gear assembly 88 which engages with drive gear 90, shown in FIG. 3, which is activated by selection handle 92 located on the exterior of the vending apparatus 10.

Figure 10:
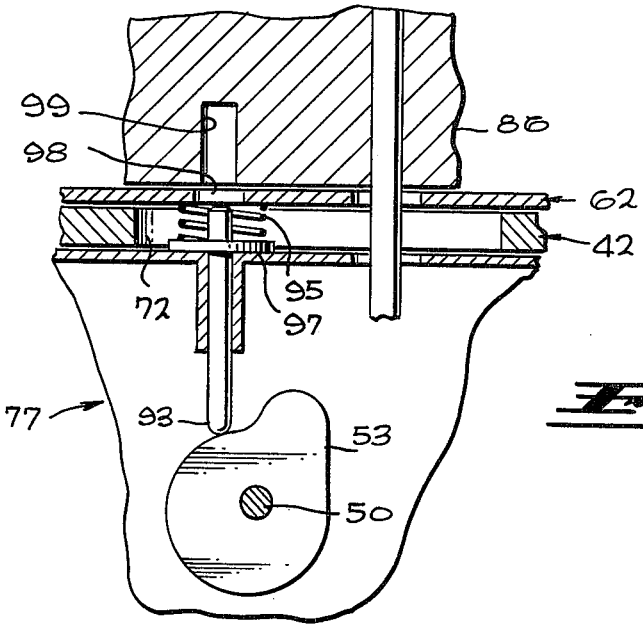
FIG. 10 is a detailed sectional view of the operation prevention mechanism for preventing operation of the apparatus when a compartment is not properly aligned.

As shown in greater detail in FIG. 10, a riding rod 93 rides upon cam 53 and is biased toward said cam by means of spring 95 which is in compression between collar 97 and the bottom surface of the cover plate 62. The riding rod 93 passes through the opening 72 in carrying plate 42 and hole 97 in the cover plate 62, permitting the top end of the riding rod 93 to pass into an alignment hole 99 in the bottom of hub 86 when a compartment is in alignment with opening 64.

The cam 53 is so designed that rotation of cam 53 in the proper direction upon activation of handle 38 lifts riding rod 93. In the presence of an opening 99 the rod 93 passes into the opening 99 permitting continued rotation of handle 38 and the rotation of carrying plate 42. If no opening 99 is present then riding rod 93 cannot be lifted and the rod prevents further movement of the cam 53.

The generally rectangular item holding compartments 74 are positioned so as to align with the openings 64 in cover plate 62 and correspond to the dimensions of the items to be dispensed. The gear assembly 88 comprises a plurality of equally spaced depressions 94 for engagement by a detent means 96 illustrated in FIG. 3 as a spring loaded ball 98 for restricting rotary movement of the compartmentalized member 66 when an item holding compartment 74 is in alignment with the opening 64 in the cover plate 62.

Figure 3:
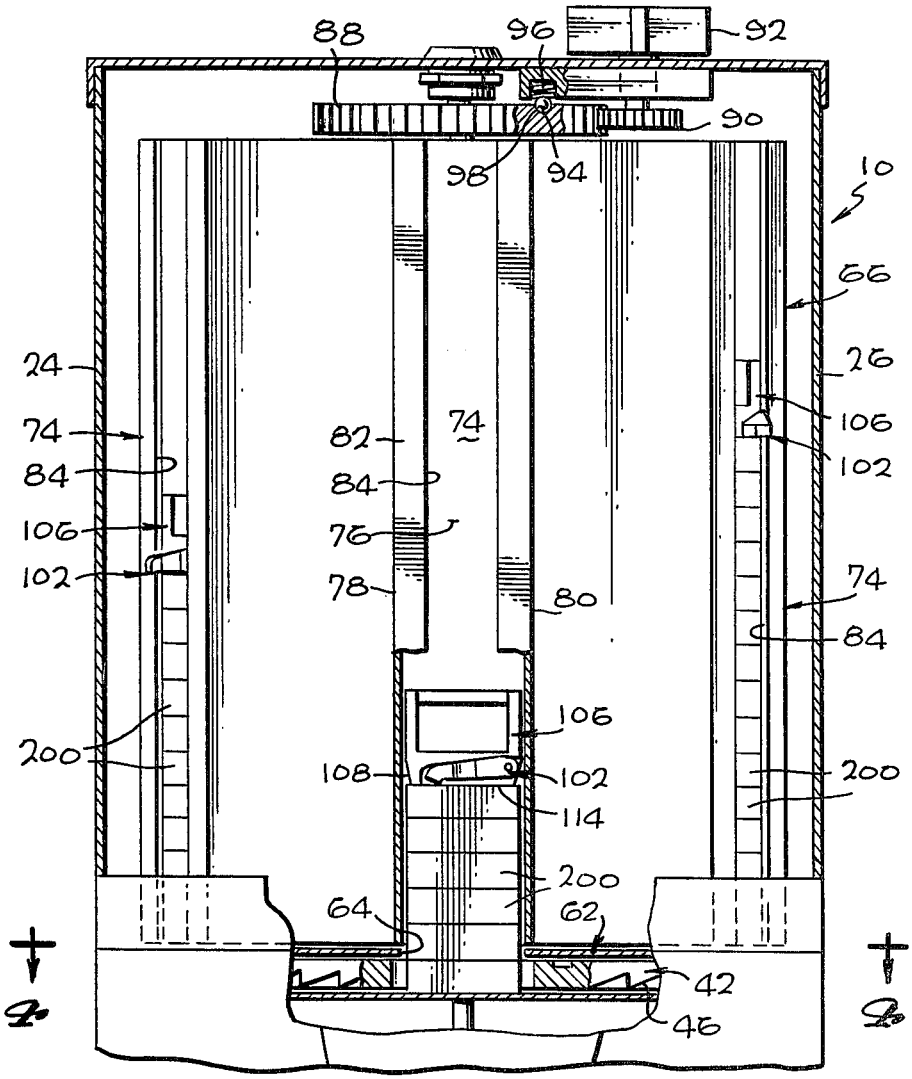
FIG. 3 is a partial sectional, front elevaton view, along line 3—3 of FIG. 1.
Figure 6:
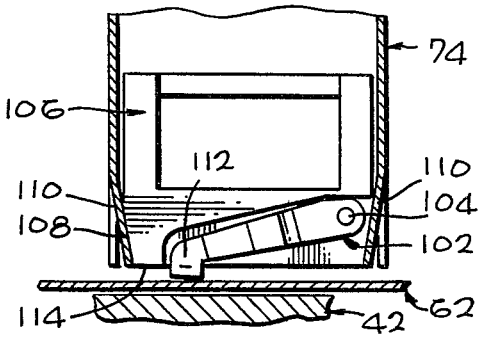
FIG. 6 is a sectional view of a compartment with all items dispensed.
Figure 7:
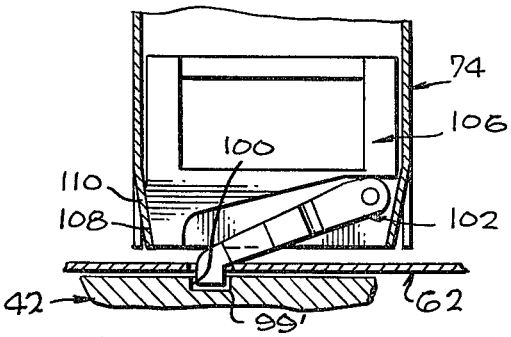
FIG. 7 is a sectional view with the vending apparatus inhibited from operation.
Figure 5:
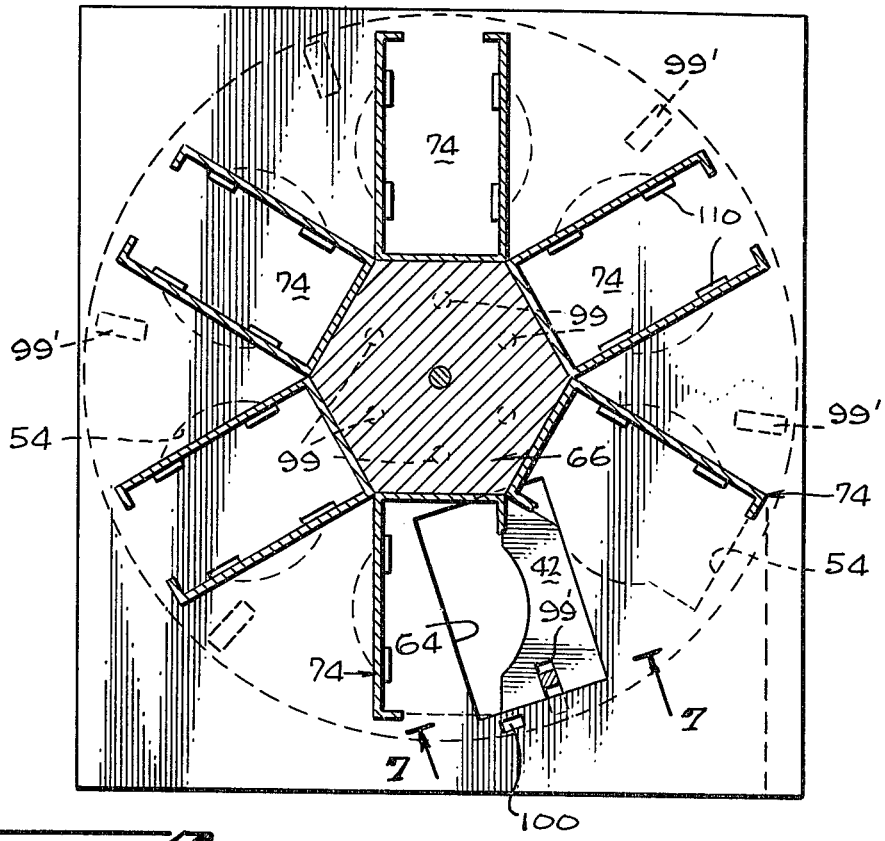
FIG. 5 is a detailed sectional view along line 4—4 of FIG. 3 showing the vending apparatus inhibited from operation.

Carrying plate 42 has a plurality of spaced depressions 99 in its top surface 44 associated with each of the item receiving openings 54 which may be rotated into alignment with stop opening 100 positioned proximate the opening 64 in cover plate 62, for cooperation with stop element 102 pivotably mounted at 104 to stop member 106, as shown in FIGS. 3, 6 and 7. The weighted stop member 106 comprises a substantially H-shaped metal member mounted on a block having a tapered lower portion 108. The dimensions of the block correspond generally to the dimensions of the item holding compartments 74. Each of the item holding compartments 74 has a crimped portion 110 along the bottom edge to prevent passage of the stop member 154 without prevention of passage of the items to be dispensed.

The stop element 102 is pivotably mounted to the stop member 106 so that at least a portion 112 of the stop element 102 is movable between a first and second position under the influences of gravity. The stop element 102 is contained in its first position substantially above the plane formed by the bottom surface 114 of the stop member 106 and is pivotable above pivot 104 to a position below the surface 114 of the stop member 106 when not restrained. A portion of the stop element 112 passes through the slot 84 in the item holding compartments.

Referring to FIGS. 6 and 7, the stop member 106 and stop element 102 are shown in detail. As illustrated, the stop element 102 comprises a substantially linear member pivotably mounted at one end 104 and having a downwardly projection tip 112 of such a dimension to pass through stop opening 100 in cover plate 62 and enter at least a portion of depression 99 in carrying plate 42.

The operation of the improved vending machine of the present invention is as follows.

Figure 2:
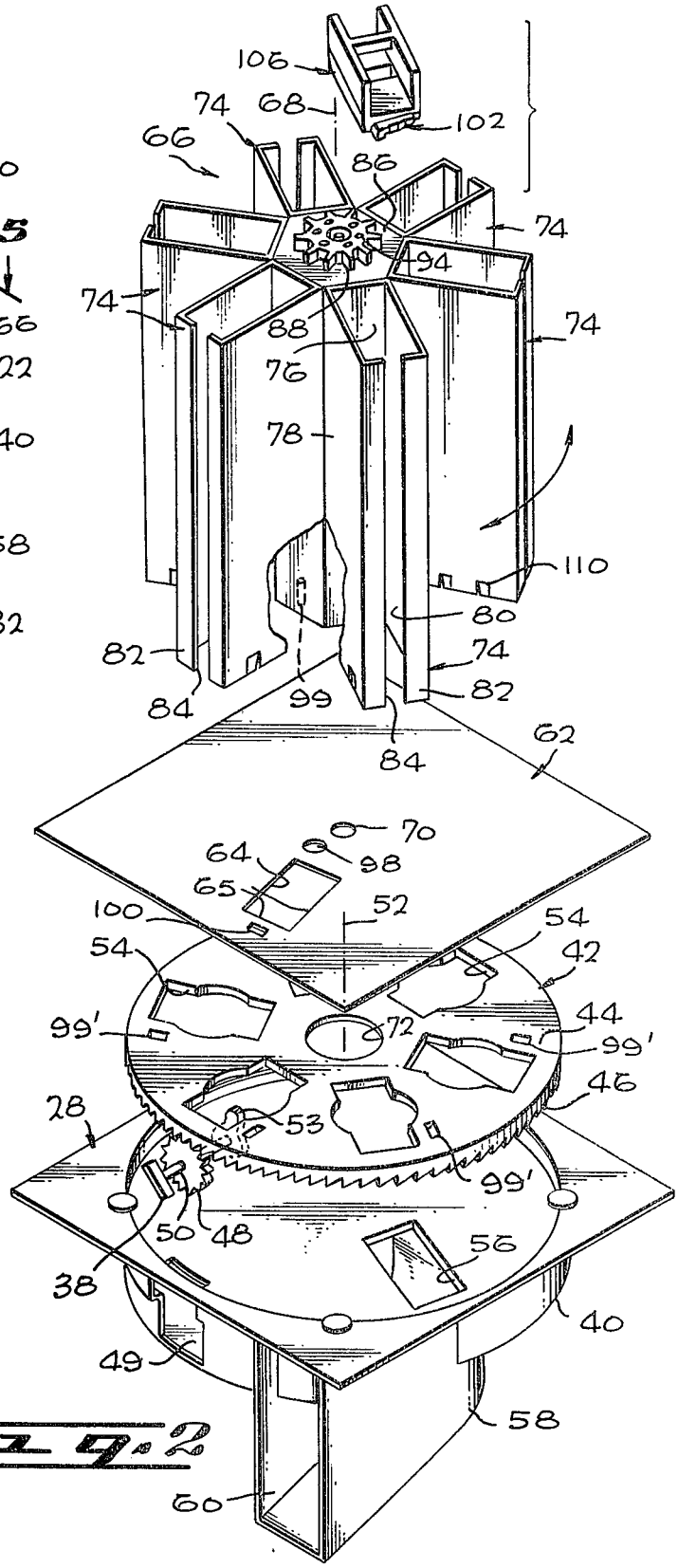
FIG. 2 is an exploded view of components utilized in the present invention.

Referring to FIGS. 1 and 2, the lock 16 is opened and top cover 12 is removed. The individual items to be dispensed are deposited in each of the item holding compartments 74 in the arrangement desired. A different type of item would be installed in each of the different individual item holding compartments 74. Of course, if desired, the same type of item may be placed in each item holding compartment 74. Once the desired number of items 200 are deposited, as shown in FIG. 3, the stop members 106 are placed on top of the items 200 to be dispensed in each compartment. The stop member 106 is oriented so that the projecting end 112 of stop element 102 trails the end of the stop element 102 pivoted at 104, when rotated in a counterclockwise direction when viewed as in FIG. 3.

The selector handle 92 is rotated, thereby engaging the gear network 88 rotating the compartmental member 66 about its longitudinal axis 68. The selection handle 92 may be rotated in either direction until the item holding compartment 74 which contains the item desired to be selected is at the front of the vending apparatus 10 where the contents of the item holding compartment 74 may be viewed through the substantially transparent front wall 20. The detent means 96 substantially restricts movement of the compartmental member 66 when an item holding compartment 74 is properly positioned. Opposition to movement of the compartmental member 66 may be overcome by applying additional force to the selection handle 92. The selected item holding compartment 74 from which it is desired to obtain an item 200 is thus brought into direct alignment with cover plate opening 64. The cover plate 62 being essentially a sheet of thin sheet metal is thin enough so as not to prevent an item 200 from catching on a side edge 65 of opening 64 as the compartmental member 66 passes over the opening 64. The tapered edge 65 of the cover plate opening 64 further minimizes the possibility that the items 200 contained in the individual item holding compartments 74 will catch on the sides of the opening 64. In activation, assembly 77 prevents activation of the handle 38 when an item holding compartment 74 is not in alignment with the cover plate opening 64.

An item receiving opening 54 in carrying plate 42 is not in alignment with the cover plate opening 64 prior to activation of the handle 38. Thus, any items 200 contained in the individual item holding compartments 74 which are in alignment with cover plate 64 cannot drop into the opening 54 in the carrying plate 42, as the item holding compartments 74 are rotated about the central axis 68. Instead, the items 200 pass momentarily over cover plate opening 64 resting on a portion of the top surface of carrying plate 42. Due to the thinness of the sheet metal cover plate 62 and the tapered edge 65 of the cover plate opening the items 200 contained in the item holding compartments are not retained by the cover plate opening 64.

Figure 4:
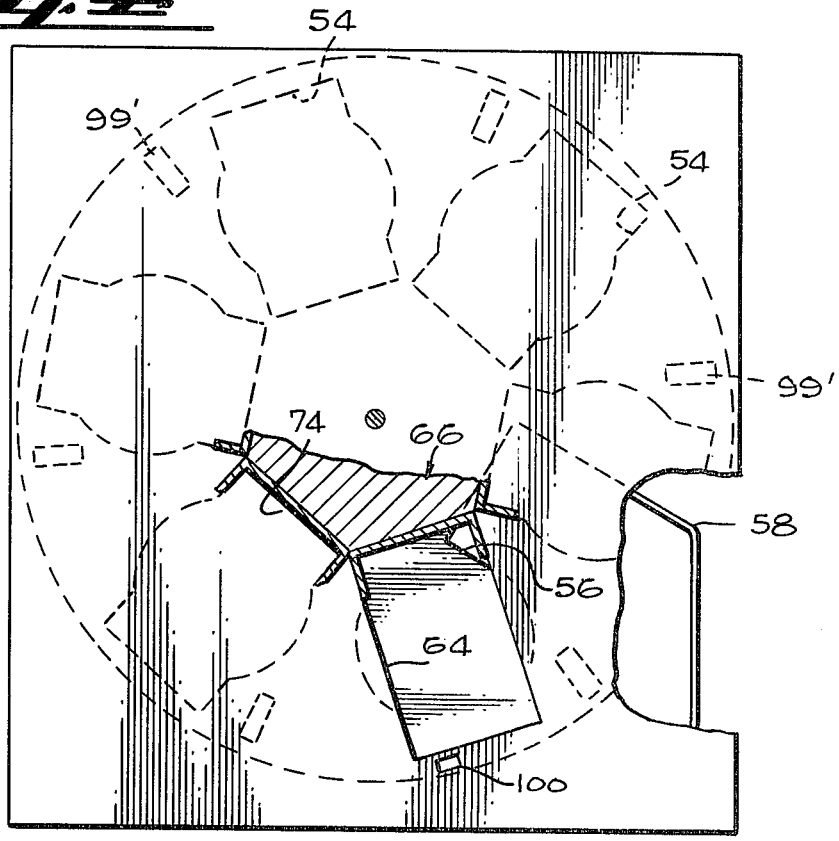
FIG. 4 is a view along line 4—4 of FIG. 3.
Figure 8:
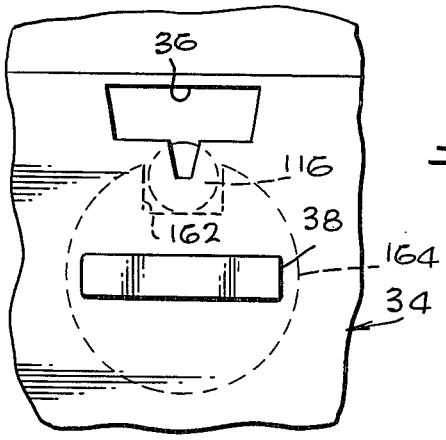
FIG. 8 is a partial sectional view of the coin assembly of FIG. 1 illustrating a coin inserted into the coin receiving slot during normal machine operation.

When a properly sized coin 116 is inserted in the coin receiving opening 36, rotation of handle 38 is permitted. Rotation of handle 38 results in translation gear 48 imparting rotational movement to carrying plate 42 due to translation gears 48 engagement with gear teeth 46 located on the lower circumferential edge of carrying plate 42. As the carrying plate rotates in a counterclockwise direction as viewed in FIG. 2, an item receiving opening 54 comes into alignment with cover plate opening 64 and the item holding compartment 74. One of the items 200 contained in the item compartment 74 falls through cover plate opening 64 into the item receiving opening 54 in carrying plate 42. The depth of the item receiving opening 54 is such that only one item 200 desired to be dispensed may fit completely within the item receiving opening 54 at a time. As the activation handle 38 is continued to be rotated resulting in rotational movement of carrying plate 42 the item 200 which has been deposited in the item receiving opening 54 is carried, as shown in FIG. 4, to a position directly above dispensing opening 56. When the item receiving opening 54 is directly over the dispensing opening 56 the item 200 falls into the dispensing opening 56 and passes by means of chute 56 to the exterior of the vending machine 10. Activation handle 38 may be permitted to rotate for a small amount but not enough so that another of the item receiving openings 54 may come into alignment with the cover plate opening 64 in cover plate 62.

Figure 9:
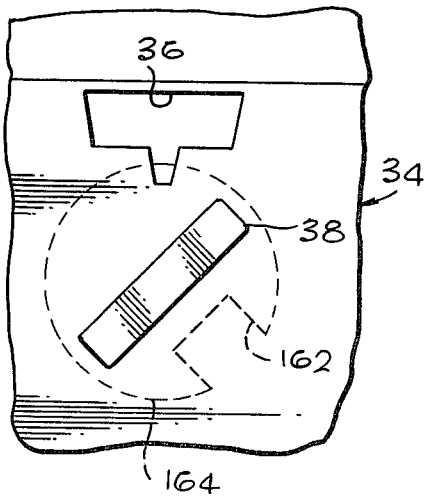
FIG. 9 is a partial sectional view of the coin assembly of FIG. 1 during attempted operation of the machine when empty.

The above process is repeated until all of the items in one of the item holding compartments 74 is depleted. At such time, stop member 66 comes to rest substantially at the bottom of the item holding compartment 74 such as shown in FIGS. 6 and 7. The pivotal stop element 102 which has its projecting tip 112 extending through the slot 84 in the front wall 82 of the item holding compartment 74 rides upon the top surface of the cover plate 62 until such time as the tip 112 is brought into alignment with stop opening 100 in the cover plate 62, such as when it was attempted to select an item from an empty item holding compartment 74. Should a coin be inserted in coin slot 36, carrying plate 42 will be permitted to rotate until such time that the tip 112 of stop element 102 is brought into alignment with stop depression 99 located in the top surface 44 of carrying plate 42, such as is shown in FIG. 7. When the stop opening 100 and the stop aperture 99 are aligned the tip 112 of stop element 102 is permitted to descend under the force of gravity stop depression 99. Thus, carrying plate 42 is maintained immovable with respect to cover plate 62, thereby preventing further rotation of carrying plate 42. Handle 38 being connected to carrying plate 42 is likewise prevented from additional rotation, such as shown in FIG. 9. The handle 38 would thus have to be returned to its initial position and the coin 116 removed.

In the preferred embodiment of the present invention, a plurality of item receiving openings 54 corresponding to the number of item holding compartments 74 are provided. However, only one such item receiving opening is required. It would be possible for the single opening 54 to be rotated in a complete 360° of travel for each dispensing operation. With six item receiving openings 54 in the carrying plate 42 only 60° of travel (360° ÷ 6) is required for each dispensing operation. With appropriate gear ratios between translation gear 48 and gear teeth 46 such travel of the carrying plate 42 may be achieved by only one rotation of activation handle 38.

Also, while the item holding compartments 74 and other openings have been illustrated as having generaly rectangularly shaped cross-sections, it is recognized that such a shape may be varied to accommodate the particular size and shape of the items desired to be dispensed. It is also recognized that prefilled cartridges of items may be directly deposited into the item holding compartments 74.

What I claim is:

1. A compartmental vending machine apparatus comprising:

(a) a compartmental member, said compartmental member comprising at least one item holding compartment having at least one open end;

(b) a carrying plate, said carrying plate having at least one opening for receiving an item to be dispensed, said opening being relatively movable with respect to said compartmental member from a first position not in alignment with said at least one opening in said item holding compartment to a second position in alignment with said at least one opening in said item holding compartment;

(c) a separation plate separating said compartment member from said carrying plate, said separation plate having an opening therein at least the size of the item to be dispensed, said separation plate opening being alignable with said openings in said carrying plate and said item holding compartment;

(d) a dispensing chute opening, said dispensing chute opening being alignable with said carrying plate opening;

(e) said carrying plate being movable relative said dispensing opening responsive to a first activation means external to the vending machine for dispensing an item received by said carrying plate opening into said dispensing opening.

2. The apparatus of claim 1, in which said compartmental member comprises a plurality of item holding compartments said item holding compartments being rotatable about a central axis whereby a selected compartment may be brought into alignment with said separation plate opening.

3. The apparatus of claim 2, in which said carrying plate comprises a disc-like member rotatable about said central axis whereby said opening in said carrying plate may be brought into alignment with said separation plate opening responsive to an activator means external the vending apparatus.

4. The apparatus of claim 3, in which said first activation means rotates said carrying plate through an angle equal to 360° divided by the number of openings in said carrying plate upon each cycle of said activation means.

5. The apparatus of claim 2, in which said compartmentalized member is rotatable responsive to a second activation means external the vending apparatus.

6. A compartmental vending machine apparatus comprising:

(a) a compartmental member, said compartmental member comprising at least one item holding compartment having at least one open end;

(b) a carrying plate, said carrying plate having at least one opening for receiving an item to be dispensed, said opening being relatively movable with respect to said compartmental member from a first position not in alignment with said at least one opening in said item holding compartment to a second position in alignment with said at least one opening in said item holding compartment;

(c) a separation plate separating said compartment member from said carrying plate, said separation plate having an opening therein at least the size of the item to be dispensed, said separation plate opening being alignable with said openings in said carrying plate and said item holding compartment;

(d) a dispensing chute opening, said dispensing chute opening being alignable with said carrying plate opening;

(e) said carrying plate being movable relative said dispensing opening responsive to a first activation means for dispensing an item received by said carrying plate opening into said dispensing opening; and (f) a disabling assembly for disabling operation of the vending machine upon depletion of the items in an item holding compartment positioned in alignment with said separation plate opening, comprising a stop member, said stop member movable in said item holding compartment, said stop member having a movable stop element cooperating with a stop element engagement means in said carrying plate when the items in said item holding compartment are depleted.

7. The apparatus of claim 6, in which said engagement means comprise a depression in said carrying plate and said stop element comprises a pivotal longitudinal member having a portion movable between a first position above the top surface of said carrying plate and a second position below the surface of said carrying plate.

8. A compartmental vending machine, comprising:

(a) a rotatable compartment member, said compartment member having a plurality of item holding compartments open at least on their bottom ends and uniformly distributed about a central hub pivotal about a central axis;

(b) a separation plate, said separation plate having an opening therethrough alignable with the item holding compartment opening upon rotation of the item holding compartment;

(c) a carrying plate, said carrying plate having at least one opening therein for receiving an item to be dispensed, said carrying plate being rotatable about said central axis responsive to an external dispensing activation means and rotatable between a first position not in alignment with said opening in said separation plate, a second position in alignment with said separation plate opening and a third position in alignment with a dispensing chute opening, whereby an item received by said carrying plate opening when aligned with said separation plate opening is received by said opening in said chute; and (d) stop means for preventing rotation of said carrying plate upon an item holding compartment in alignment with said separation plate opening being empty.

9. The apparatus of claim 8, in which said stop means comprises a stop member movable in said item holding compartment said stop member having a portion thereof extending into said carrying plate in the absence of an item in said item holding compartment.

* * * * *